United States Patent [19]

Schleupen

[11] 4,146,857

[45] Mar. 27, 1979

[54] IGNITION COIL FOR ENGINE IGNITION SYSTEM

[75] Inventor: Richard Schleupen, Ingersheim, Fed. Rep. of Germany

[73] Assignee: Robert Bosch GmbH, Stuttgart, Fed. Rep. of Germany

[21] Appl. No.: 843,985

[22] Filed: Oct. 20, 1977

[30] Foreign Application Priority Data

Nov. 10, 1976 [DE] Fed. Rep. of Germany ..... 2651218

[51] Int. Cl.[2] ..... H01F 27/02; H01F 27/26

[52] U.S. Cl. ..... 336/61; 336/96; 336/178; 336/212; 336/DIG. 2

[58] Field of Search ..... 336/DIG. 2, 212, 178, 336/96, 90, 92, 198, 61

[56] References Cited

U.S. PATENT DOCUMENTS

| | | | |
|---|---|---|---|
| 2,483,815 | 10/1949 | Easton | 336/212 X |
| 3,277,358 | 10/1966 | Nicholl | 336/DIG. 2 X |
| 3,418,552 | 12/1968 | Holmes | 336/96 X |
| 3,795,236 | 3/1974 | Jukes et al. | 336/DIG. 2 X |
| 3,840,795 | 10/1974 | Roszyk et al. | 336/DIG. 2 X |
| 4,030,058 | 6/1977 | Riffe et al. | 336/DIG. 2 X |
| 4,038,625 | 7/1977 | Tompkins et al. | 336/DIG. 2 X |

FOREIGN PATENT DOCUMENTS

| | | | |
|---|---|---|---|
| 2402069 | 7/1974 | Fed. Rep. of Germany | 336/DIG. 2 |

*Primary Examiner*—Thomas J. Kozma
*Attorney, Agent, or Firm*—William R. Woodward

[57] ABSTRACT

The rod-shaped core portion carrying the high-voltage secondary winding is separated from the U-shaped core portion carrying the primary winding by an insulating partition integral with an insulating casing that both provides galvanic separation between the primary and secondary parts of the transformer and also defines the so-called air gaps of the core.

5 Claims, 1 Drawing Figure

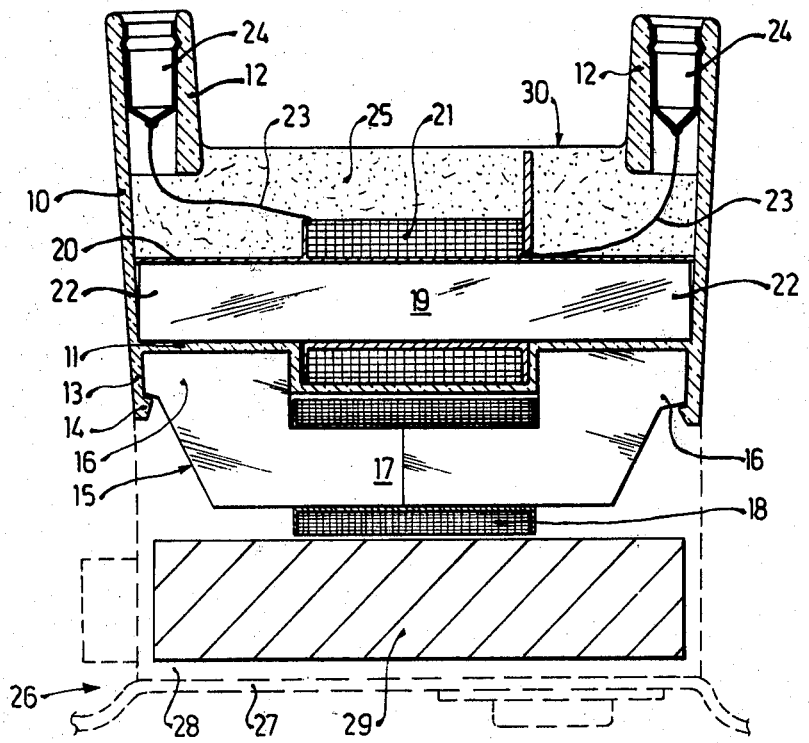
24
12
23
25
21
30
12
24
10
23
20
22
19
22
11
13
14
16
15
17
16
18
26
28
27
29

IGNITION COIL FOR ENGINE IGNITION SYSTEM

This invention concerns a new construction of an ignition transformer for the ignition system of a gasoline engine such as is used in motor vehicles. The ignition transformer is more commonly referred to as the ignition coil or spark coil and has a secondary winding that produces a pulse of high voltage when the current in a primary winding is either suddenly increased or suddenly interrupted, according to the particular type of ignition system in use. The invention deals with the kind of ignition transformer in which the primary and secondary windings are wound on different portions of the core of the transformer.

PRIOR ART

The provision of the primary and secondary windings on different parts of the core facilitates galvanic separation of the high and low voltage sides of the circuit. A known ignition coil unit of this type has a core consisting of two E-shaped parts. The core is put together by abutting the ends of the two outer legs of the E-shaped cores while inserting them into the windings, so that the primary winding will surround the combination of two of these abutting outer legs, and the secondary winding the corresponding combination of the other two abutting legs. The middle legs of the two core parts run between the primary and secondary windings and are held together by a clip or the like. The purpose of this kind of construction is to provide a connection that is releasable easily and quickly at any time between the casing made of casting resin and the magnetic cores insertable therein. The construction is designed for situations in which the casing holding the same windings is to be selectively utilized either for continuous service or for intermittent service, or for heavy or light duty, without involving difficulties or time consuming operations for interchanging magnetic cores to suit the air gap of the cores to the particular type of operation.

THE PRESENT INVENTION

It is an object of the present invention to provide an ignition coil structure in which there will be effective galvanic separation between the primary and secondary circuit portions and in which secondary voltages up to 40 kV are obtainable without risk of voltage breakdown or other such damage.

Briefly, an insulating partition wall is provided between two portions of the core that respectively carry the primary and secondary windings. This insulating partition wall is preferably made integral with a casing that partly encloses the device. A first core portion is of flat-bottomed U-shaped configuration and substantially rectangular cross-section and carries the primary winding on its straight mid-portion between the legs of the U, each of which are shorter than the mid-portion. The second core portion, also of substantially rectangular cross-section, is of straight rod shape and has ends extending out of the secondary winding mounted on its mid-portion, these ends having flat sides parallel and close to the upward-facing end faces of the legs of the first core portion, spaced from each other only by the insulating partition. The partition wall thus provides the narrow gap in the magnetic circuit of the core as well as the galvanic separation between the primary and secondary circuits.

The casing and partition wall can conveniently be integrally made in tub shape, with a partition wall forming the bottom of the tub, and catches can extend down from the partition wall for holding the part of the core holding the primary winding in place against the partition wall, so that that part of the core and its winding can readily be inserted into place and can be removed if necessary. The part of the core carrying the secondary winding is preferably insulated by a layer of insulation material from the secondary winding and from the cast material ("potting compound") that fills the remainder of the tub cavity in which the secondary coil is placed. The insulating casing is preferably seated in a pedestal base that completes the enclosure of the part of the core that carries the primary winding and also provides space for additional circuit components. The pedestal base preferably has a metal base mounting plate that also serves as the cooling plate.

The construction of the invention has the advantage that the insulating wall galvanically separating the secondary side of the device from the primary side can be quite simply manufactured in large quantity. A further advantage is that the insulation between the two windings can be individually tested before assembly of the ignition coil unit. Since the thickness of the insulating material at the same time determines the gap width in the magnetic circuit, the construction according to the present invention is also advantageous in providing an economical and effective way of fixing this design parameter of the device.

Having the end section of the cores fitting flush to the insulating wall reduces the primary winding resistance and the stray inductance. The iron surface at the gap so provided can be varied in a simple way in accordance with the required insulation thickness (dependent upon required breakdown strength) between the primary and secondary sides of the device. The provision of catches for easily and securely placing the primary side of the device in position has convenience for servicing and maintenance and makes possible interchangeable primaries in kit style for different types of service. The pedestal base featured favors not only effective heat dissipation, but also the assembly of control or switching components of the ignition circuit in the ignition coil unit.

DRAWING

The invention is further described by way of illustrative example with reference to the accompanying drawing, the single FIGURE of which is a diagrammatic vertical cross section, not drawn to scale, of an ignition coil unit according to the present invention.

As shown in the drawing, the casing 10 of insulating material is essentially of tub shape and the tub bottom forms a continuous and complete insulating partition wall 11. Extending below the casing 10 where it joins on the insulating partition forming its bottom, at each of the narrow sides of the casing 10, there extends downward a strip 13 carrying a catch 14 which can be pressed outward because of the elasticity of the integral strip 13, but takes the position indicated in the drawing when at rest.

A primary core portion 15 composed of two parts has a shallow U shape. On the straight middle portion 17 forming the bottom of the U the primary winding 18 is mounted directly on the core member 15, that is, without any intermediate spool or layer, the insulation of the primary winding wire itself being sufficient for this part of the electrical circuit. Each of the two end sections 16 of the core portion 15 that extend beyond the primary winding 18 lies directly against the insulating wall 11 and, furthermore, engages in the catch 14 of the casing 10 in a firm but releasable connection that holds the end sections 16 of this portion of the core firmly against the insulating wall 11.

A rod-shaped secondary core 19 provides the remaining portion of the transformer core. The core portion 19 is partly insulated by a layer 20 that is integral with a spool for the secondary winding 21 which encircles the middle portion of the secondary core 19. The two end sections 22 extending out of the secondary winding 21, again, lie directly against the insulating partition wall 11 without any intervening material, so that the thickness of the insulating partition 11 determines the width of both gaps in the core, usually referred to as "air gaps" although in this case they are filled with a different dielectric. These gaps are designed in the usual way to determine the magnetic flux linking the core portions 15 and 19. In a typical case, the wall thickness will be 0.5 to 1.0 mm.

The end leads 23 of the secondary winding 21 respectively connect to connector bushings 24 for receiving connection plugs, each bushing 24 being located in a cylindrical riser formed integrally with the casing 10. The remaining portion of the upper casing cavity 30 is insulatingly filled up with a cast material 25 of the potting compound variety. The layer 20 insulates the secondary core portion 19 from the secondary winding 21 and from the potting compound 25.

A pedestal base 26 made of sheet metal seats and supports the casing 10 and has a mounting plate 27 that also is capable of serving as a cooling plate. Not all of the space enclosed by the pedestal 26 is occupied by the primary core portion 17 and the primary winding 18, and there is also space beneath the primary portion of the ignition transformer for housing switching and/or control components of the electrical circuits of the ignition system, these being symbolically indicated in the drawing by the shaded rectangle 29.

Although the invention has been described with respect to a particular illustrative embodiment, variations are possible within the inventive concept.

I claim:

1. An ignition coil for a gasoline engine ignition system comprising a first ferromagnetic core portion (15) of flat-bottomed U-shaped configuration and substantially rectangular cross-section having legs (16) shorter than the length of the bottom of the U and having a primary winding (18) mounted on the straight portion (17) thereof forming the flat bottom of the U shape;

a second ferromagnetic core portion (19) of substantially straight rod shape and substantially rectangular cross-section having a secondary winding (21) for producing a high voltage mounted thereon and having end portions (22) extending out of said secondary winding, said end portions having flat sides parallel and close to the upward-facing end faces of the legs (22) of said first ferromagnetic core portion (15);

an insulating partition wall (11) galvanically separating said first core portion and primary winding from said second core portion and secondary winding, and an external casing (10) of insulating material surrounding at least said second core portion at least in the neighborhood of the periphery of said partition wall.

2. An ignition coil as defined in claim 1, in which said insulating partition is integral with said casing, in which said casing (10) and partition (11) together are of tub shape, with said partition providing the bottom of said tub, and said second core portion and secondary winding rest on said insulating partition (11) formed as a tub bottom and are embedded in a mostly overlying mass of cast material (25).

3. An ignition coil as defined in claim 2, comprising also a layer (20) of insulation for insulating said second core portion (19) from said secondary winding (21) and from said cast material (25).

4. An ignition coil as defined in claim 2, in which the body of insulating material formed by said partition and said casing is provided with catch members (13, 14) for holding said first core portion (15) with its said legs (16) lying snugly against the underside of said partition (11), said first core portion (15) and primary winding (18) being insertable into position against said insulating partition (11) between said catch members (13, 14) and also removable when said catch members are forced apart.

5. An ignition coil as defined in claim 2, comprising also a pedestal base member (26) in which said casing (10) is seated for completing the enclosure of said core portions and windings, said pedestal base member (26) providing also space for additional circuit elements and having a mounting plate (27) of metal serving also as a cooling plate.

* * * * *